US008899193B2

(12) United States Patent
Lippitt et al.

(10) Patent No.: US 8,899,193 B2
(45) Date of Patent: Dec. 2, 2014

(54) IN-LINE SIX INTERNAL COMBUSTION ENGINE

(71) Applicant: Lippitt Engine, LLC

(72) Inventors: Raymond F. Lippitt, Smithfield, NC (US); Guy M. Mason, Selena, NC (US)

(73) Assignee: Lippitt Engine, LLC, Smithfield, NC (US)

( * ) Notice: Subject to any disclaimer, the term of this patent is extended or adjusted under 35 U.S.C. 154(b) by 0 days.

(21) Appl. No.: 13/839,992

(22) Filed: Mar. 15, 2013

(65) Prior Publication Data

US 2014/0261338 A1 Sep. 18, 2014

(51) Int. Cl.
*F02D 7/00* (2006.01)

(52) U.S. Cl.
USPC ..... 123/52.3; 123/198 F; 123/58.1; 123/311

(58) Field of Classification Search
USPC ..... 123/198 F, 52.3, 58.1, 311
IPC ..... F02B 2075/1824,2075/027, 41/06, F02B 75/20
See application file for complete search history.

(56) References Cited

U.S. PATENT DOCUMENTS

| | | | | |
|---|---|---|---|---|
| 3,472,212 | A | 10/1967 | Chamberlain | |
| 3,623,463 | A | 11/1971 | Vries | |
| 4,172,434 | A | 10/1979 | Coles | |
| 6,978,204 | B2 | 12/2005 | Surnilla et al. | |
| 6,988,471 | B2 * | 1/2006 | Chang | 123/90.12 |
| 7,080,615 | B2 * | 7/2006 | Shinogle | 123/90.16 |
| 2005/0022755 | A1 | 2/2005 | Hitomi et al. | |
| 2008/0029057 | A1 * | 2/2008 | Hergart et al. | 123/198 F |
| 2009/0145396 | A1 * | 6/2009 | Almkvist et al. | 123/198 F |
| 2009/0183699 | A1 | 7/2009 | Sturman | |
| 2010/0229806 | A1 | 9/2010 | Kemeny | |
| 2011/0251773 | A1 | 10/2011 | Sahandiesfanjani et al. | |

FOREIGN PATENT DOCUMENTS

| | | | |
|---|---|---|---|
| GB | 301 667 | A | 12/1928 |

OTHER PUBLICATIONS

Intl. Search Report/Written Opinion dated Apr. 21, 2014 of PCT/US2013/070387 filed Nov. 15, 2013 (17 pages).

* cited by examiner

*Primary Examiner* — M. McMahon
(74) *Attorney, Agent, or Firm* — Pillsbury Winthrop Shaw Pittman LLP

(57) ABSTRACT

One non-limiting object of the present invention is to provide modifications to conventional in line 6 cylinder engines capable of increasing their efficiency in operation. This includes modifying the central two adjacent piston and cylinder assemblies of the engines. The modifications involve (1) changing the camshaft so that the central two adjacent piston and cylinder assemblies have their four stroke cycles in phase rather than 180° out of phase, (2) providing a communicating passage between the combustion chambers of the central two piston and cylinder assemblies and (3) modifying either the hardware or programming for the control of the fuel injectors of the central two piston and cylinder assemblies so that they can be selectively controlled not to inject fuel during the operation cycle thereof. The modifications contemplates providing a new cam shaft in which not only the cams relating to the central two adjacent piston and cylinder assemblies are modified to change 180° out of phase to in phase, but the cams relating to other piston and cylinder assemblies in order to provide a somewhat balanced application of the driving forces during each cycle.

11 Claims, 4 Drawing Sheets

IN-LINE SIX INTERNAL COMBUSTION ENGINE

FIELD OF INVENTION

This invention relates to internal combustion engines and more particularly to modifications of conventional in line six engines capable of increasing the miles per gallon of the modified engines when embodied in motor vehicles.

BACKGROUND OF THE INVENTION

Conventional in line six cylinder engines if modified to make them 20% more efficient in terms of mpg can meet the requirements mandated by the US government starting in 2014. The conventional in line six cylinder engine is currently the engine of choice for most semi rigs and many other heavy trucks that come within the government mandate.

SUMMARY OF THE INVENTION

One non-limiting object of the present invention is to provide modifications to conventional in line 6 cylinder engines capable of increasing their efficiency in operation, preferably by at least 20%, thus making them suitable to satisfy the market in large trucks and semi tractors which must be created by 2014 in order to meet the government mandates as to mpg. This objective increase is achieved by the present invention by modifying the central two adjacent piston and cylinder assemblies of the engines so that they operate in accordance with the principles of my pending patent application Ser. No. 13/475,253, the disclosure of which is hereby incorporated by reference into the present application. The modifications involved (1) changing the camshaft so that the central two adjacent piston and cylinder assemblies have their four stroke cycles in phase rather than 180° out of phase, (2) providing a communicating passage between the combustion chambers of the central two piston and cylinder assemblies and (3) modifying either the hardware or programming for the control of the fuel injectors of the central two piston and cylinder assemblies so that they can be selectively controlled not to inject fuel during the operation cycle thereof. The modifications contemplates providing a new cam shaft in which not only the cams relating to the central two adjacent piston and cylinder assemblies are modified to change 180° out of phase to in phase, but the cams relating to other piston and cylinder assemblies in order to provide a somewhat balanced application of the driving forces during each cycle.

It is preferable in accordance with the principles of the present invention to provide a maximum fuel saving mode wherein alternately one of the two cylinders firing is cut off from fuel. It is also an object of the present invention to provide new engines wherein two cylinders fire over 120° of crankshaft rotation constructed to embody the modifications herein provided hereinbefore indicated.

Various options within the invention are as follows.

The camshaft may be constructed and arranged so that the firing strokes of the two outer and intermediate assemblies are simultaneous, the fuel injecting and firing system being operable to selectively control the injectors of the two outer and intermediate assemblies in a third mode wherein one injector associated with each of the two outer and two intermediate assemblies is controlled to inject zero amount of fuel.

The fuel injecting and firing system may be operable to control an injector to inject fuel into a cylinder during an associated piston stroke when the compressed air in the associated combustion chamber has reached an auto ignition pressure so that the igniting of the mixture occurs as a result of the injection.

The fuel injecting and firing system may be operable to control an injector to inject fuel into a cylinder during an associated piston intake stroke and the mixture of fuel and compressed air in the associated combustion chamber is ignited by energizing a spark plug in communicating relation to the mixture.

An aspect of the invention also includes a method of increasing the efficiency of a six cylinder in line engine having six piston and cylinder assemblies mounted in line formation within a frame, the assemblies having pistons connected to a crankshaft so that the pistons of two inner adjacent assemblies, two outer assemblies and two intermediate assemblies move through repetitive cycles of reciprocating movement offset with respect to one another by 120° of crankshaft rotation in which each cycle has four strokes of movement alternately in opposite directions which take place during successive 180° rotational movements of the crankshaft, a crankshaft for controlling inlet and outlet valves to allow air to be taken into a cylinder during an intake stroke of each assembly and to be compressed into a combustion chamber within a cylinder of each assembly during and immediately following compression stroke of each assembly and a fuel injecting and firing system including an injector for each assembly operable to supply fuel during a stroke of the assembly so that when a charge of air under pressure mixed with fuel is ignited within a combustion chamber the resultant increase in pressure in the associated cylinder affects a power stroke of an associated piston immediately following the compression stroke of the assembly, the method comprising:

replacing the camshaft of the engine which controls the valves of the inner assemblies with a replacement camshaft constructed and arranged so that the cycles of piston movement of the two inner assemblies are in phase, providing a communicating passage between the combustion chambers of the two inner assemblies, and modifying the fuel injecting and firing system so that the injectors for the two inner assemblies are selectively operable to operate (1) in a normal mode wherein the injectors associated with both inner assemblies operate to supply fuel during a stroke of both assemblies so that when a charge of air under pressure mixed with fuel is ignited within both combustion chambers the resultant increase in pressure in both cylinders affects a power stroke in both cylinders or (2) in a fuel saving mode wherein the injector associated with one of the inner assemblies operates to supply fuel during a stroke of the associated piston so that when a charge of air under pressure mixed with fuel within the combustion chamber of the one of the inner assemblies is ignited, the resultant increase in pressure in the combustion chamber of the one of the inner assemblies is communicated through the passage with the air under pressure in the combustion chamber of the other of the inner assemblies to affect the power stroke of both assemblies.

Other various options of the method may include the following.

The compression stroke of each assembly may create an auto-ignition compression pressure and wherein the mixture is ignited by injecting fuel into the air under auto-ignition pressure within the associated combustion chamber.

The mixture of air and fuel in the associate combustion chamber by injecting fuel with the intake of air during each intake stroke and the mixture may be ignited by the energization of a spark plug in communication with the mixture.

The new camshaft may control the valves of the two outer and two intermediate assemblies so that cycles of the two outer and two intermediate assemblies are in phase, and the injectors of the fuel injecting and firing system associated with the two outer and two intermediate assemblies are controlled in a third mode wherein one of the injectors of the two outer and two intermediate assemblies inject a zero amount of fuel.

The passage may be provided by grinding inwardly of a seal engaging surface of the frame between the cylinders of the two inner assemblies.

The fuel injecting and firing system may be controlled by a computer and the modification of the system is achieved by reprogramming the computer.

The fuel injecting and firing system may be controlled by pumping fuel under pressure through individual lines to each injector in timed relation and the modification of the system is achieved by modifying the lines to the injectors.

Other objects, features, and advantages of the present invention will become apparent from the following detailed description, the accompanying drawings, and the appended claims.

DETAILED DESCRIPTION OF THE INVENTION

Figure 1:
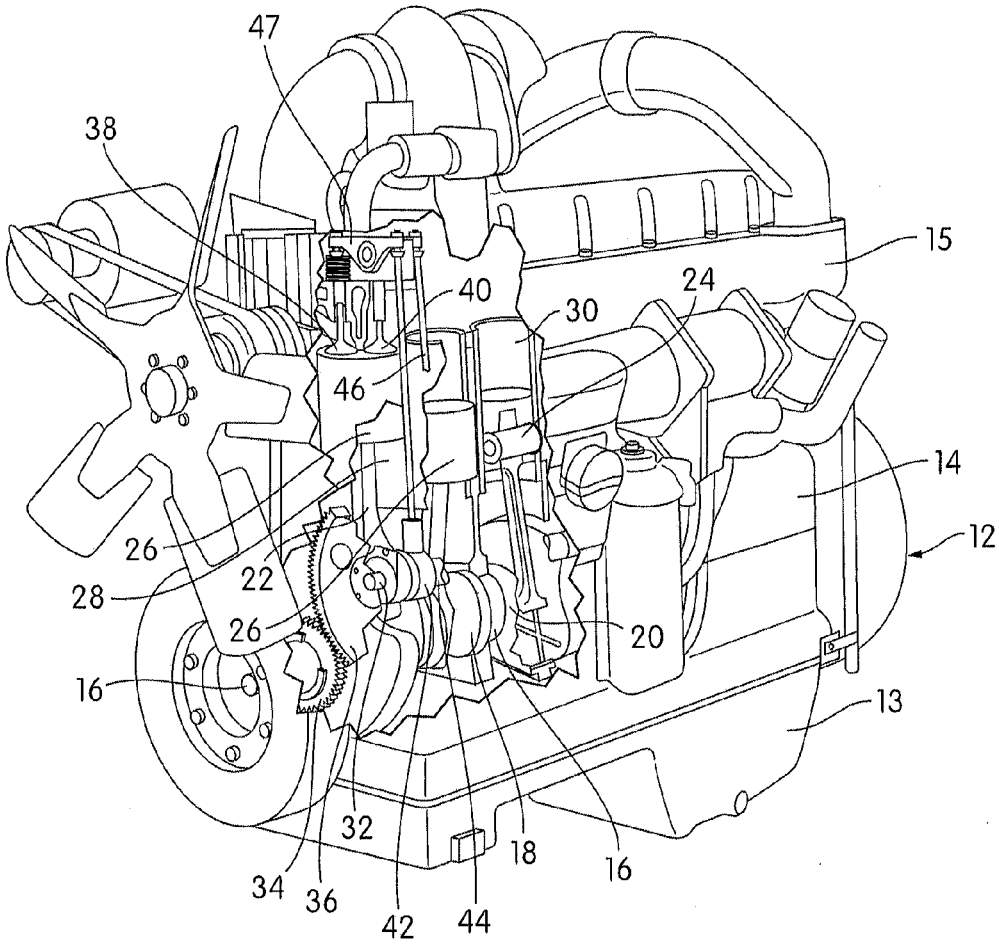
FIG. 1 is a perspective view of a conventional in line six cylinder engine with parts broken away for purposes of clearer illustration.

FIG. 1 shows a prior art six cylinder in line diesel engine 10 which includes a main frame 12 having a pan 13 detachably fixed to the lower end of a crankcase portion 14 thereof. Mounted within the crank case portion 14 is a crankshaft 16 journaled in main bearings 18. The crankshaft 16 includes six crankpin bearings 20 on which the bolt secured split ends of six connecting rods 22 are journaled. The opposite ends of the six connecting rods 22 are journaled in six wristpin bearings 24 mounted within six pistons 26 respectively. The six pistons 26 are in-line oriented slidably sealingly mounted in six in-line oriented cylinders 28 formed by six in-line oriented cylinder liners 30 removably fixed within the frame 12.

The connecting rods 22 are journaled at one end on the crankshaft 16 and at the other end on the pistons 26 which causes the pistons 26 to be reciprocated within the cylinder liners 30 through a cycle of four reciprocating strokes while the crankshaft is rotated through two rotations.

The four events which occur within the cylinders 28 during each four stroke cycle include, in order, intake compression, fire, and exhaust. The events are accomplished in response to a camshaft 32 which is suitably journed on the frame 12. The camshaft 32 is mounted in a position to be driven by the crankshaft 16. The drive is accomplished by a gear 34 fixed on the crankshaft 16 to rotate therewith and a meshing gear 36 of twice the size of gear 34 fixed on the camshaft 32 so that the camshaft 32 rotates at half the speed of the crankshaft 16.

The four events are accomplished by reciprocating inlet valves 38 spring biased to close inlet openings leading into the cylinders 28 above the pistons 26 and outlet or exhaust valves 40 spring biased to close outlet openings leading from the cylinders 28 to an exhaust manifold (not shown) forming a part of an exhaust system including an exhaust pipe (not shown).

The inlet and outlet valves 38 and 40 are moved into opening relation to the inlet and outlet openings against their spring bias by inlet and outlet cam lobes 42 and 44 on the camshaft 32 which move inlet and outlet lifter rods 46. The inlet and outlet valves 38 and 40 are actively moved by one ends of inlet and outlet rocker arms 47, the other ends of which are moved by the inlet and outlet lifter rods 46.

Figure 4:
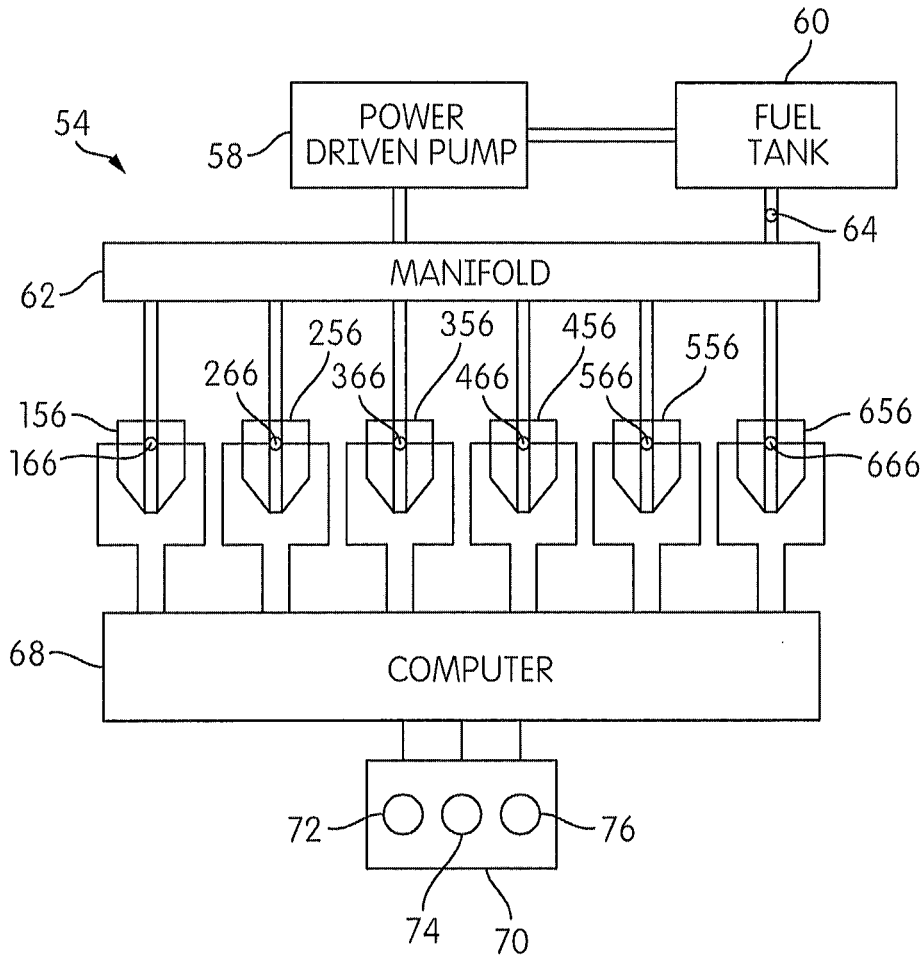
FIG. 4 is a schematic and block diagrammatic view of a third modification in accordance with the principles of the present invention in the form of a modified fuel injecting and firing system.

The position of the cam lobes 44 on the camshaft 32 cause (1) the inlet valve 38 associated with each cylinder to be open at an appropriate time so that the inlet opening is open during the inlet stroke event of the cylinder cycle (2) cause the outlet valve 40 associated with each cylinder to be opened at an appropriate time so that the outlet opening is open during the outlet or exhaust stroke event. The inlet and outlet valves 38 and 40 are allowed to remain in their spring biased closed position during the compression stroke event of each cycle wherein the air in the cylinder taken in during the intake stroke event is compressed to an auto ignition pressor. The inlet and outlet valves 38 and 40 also remain closed during the firing stroke during which diesel fuel is injected into the cylinder by a computer controlled fuel injecting and firing system, generally indicated at 48; modification of which is shown in FIG. 4 and will be described in detail hereinafter.

It will be understood that the conventional in-line six cylinder engine also has accessories such as an alternator, fuel and air filters, an oil pump, a turbo charger, a super charger, etc., which remain unmodified in accordance with the principles of the present invention and hence are either not shown in the drawings or described in detail herein.

It can be seen that the conventional engine 10 includes six in-line crankshaft driven piston and cylinder assemblies, which can be conveniently identified from left to right as 1 through 6 respectively. Each of the piston and cylinder assemblies 1-6 includes a cylinder liner 30, a piston 26 and a connecting rod 22, which can be referred to as cylinder 1, piston 1 or connecting rod 1, cylinder 2, piston 2 or connecting rod 2, etc., for purposes of clearly identifying each one of six. Parts that are replicated for each piston/cylinder 1-6 may be denoted in the drawings by the number referring to that part herein preceded by a 1-6. For example, the six lobes 42 and 44 are number 142-642 and 144-644 to match them to cylinders 1-6, and in FIG. 3 each cylinder 28 2-5 is denoted 228-528.

The six crank portions of the crankshaft 16 are arranged so that pistons 1 and 6 move together in cylinders 1 and 6, pistons 2 and 5 move together in cylinders 2 and 5 and pistons 3 and 4 move together in cylinders 3 and 4. A conventional firing order is 153624 which means that the firing stroke event takes place in successive strokes first in cylinder 1; second, in cylinder 5; third, in cylinder 3; fourth, in cylinder 6; fifth, in cylinder 2; and sixth, in cylinder 4. A cycle must take place in each cylinder in two rotations of the crankshaft (four 180° strokes) or one rotation of the camshaft (four 90° strokes). In order for six firing stroke events to take place in four incremental movements of the camshaft (90° each) or four incremental movements of the crankshaft (180° each) it is conventional that these firing stroke events be initiated 120° apart with respect to the crankshaft rotation. To accomplish the initiation of six successive firing stroke events every 120° (1) the firing stroke event in cylinder 5 is initiated 120° after the initiation of the firing stroke in cylinder 1, (2) the firing stroke event in cylinder 3 is initiated 120° after the initiation of the firing stroke event in cylinder 5, (3) the firing stroke events of cylinders 6, 2 and 4 follow in the same sequence. Also in order to achieve six successive stroke initiations within two revolutions of the crankshaft 32 the cycles of commonly used pistons 1 and 6, 2 and 5 and 3 and 4 are 180° out of phase with respect to one another.

Figure 2:
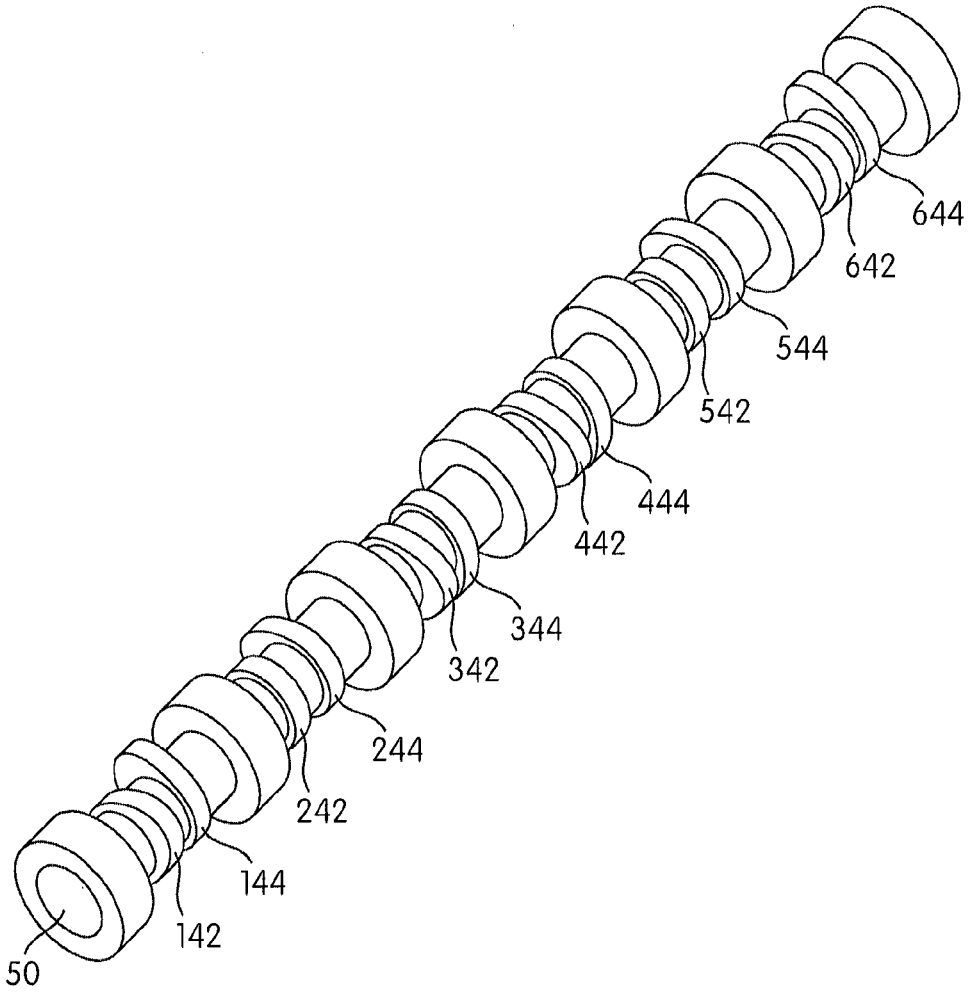
FIG. 2 is a perspective view of a first modification in accordance with the principles of the present invention in the form of a new crankshaft.

Referring now more particularly to FIG. 2, there is shown therein a first modification for the conventional engine 10 in accordance with the principles of the present invention. The modification shown in FIG. 2 is a new camshaft 50 to replace the conventional camshaft 32. The camshaft 50 is constructed to allow the two adjacent piston and cylinder assemblies to be done in phase rather than 180° out of phase. Compared with a conventional camshaft 32, new camshaft 50 has cam lobe 444 positioned on the camshaft in angular alignment with cam lobe 344 alignment therewith. This alignment of cam lobes 344 and 444 allows pistons 326 and 426 to complete their combustion strokes simultaneously so that selectively both cylinder 330 and 430 will receive an injection of diesel fuel appropriate to fire both during the following simultaneous power strokes thereof or to alternatively inject only one cylinder 330 and 430 with an appropriate amount of fuel for one of cylinders 330 and 430 to fire alternatively in only one cylinder so that the increased pressure conditions resulting from the one fire can be communicated to the other cylinder. That is, the passage allows pressure generated by fuel injected and ignited in cylinder 1330 and 430 to be communicated to the other of cylinders 330 and 430 receiving no fuel, so the pressure drives both pistons 326 and 426 simultaneously. This generates power of both pistons with one less injection charge.

Figure 3:
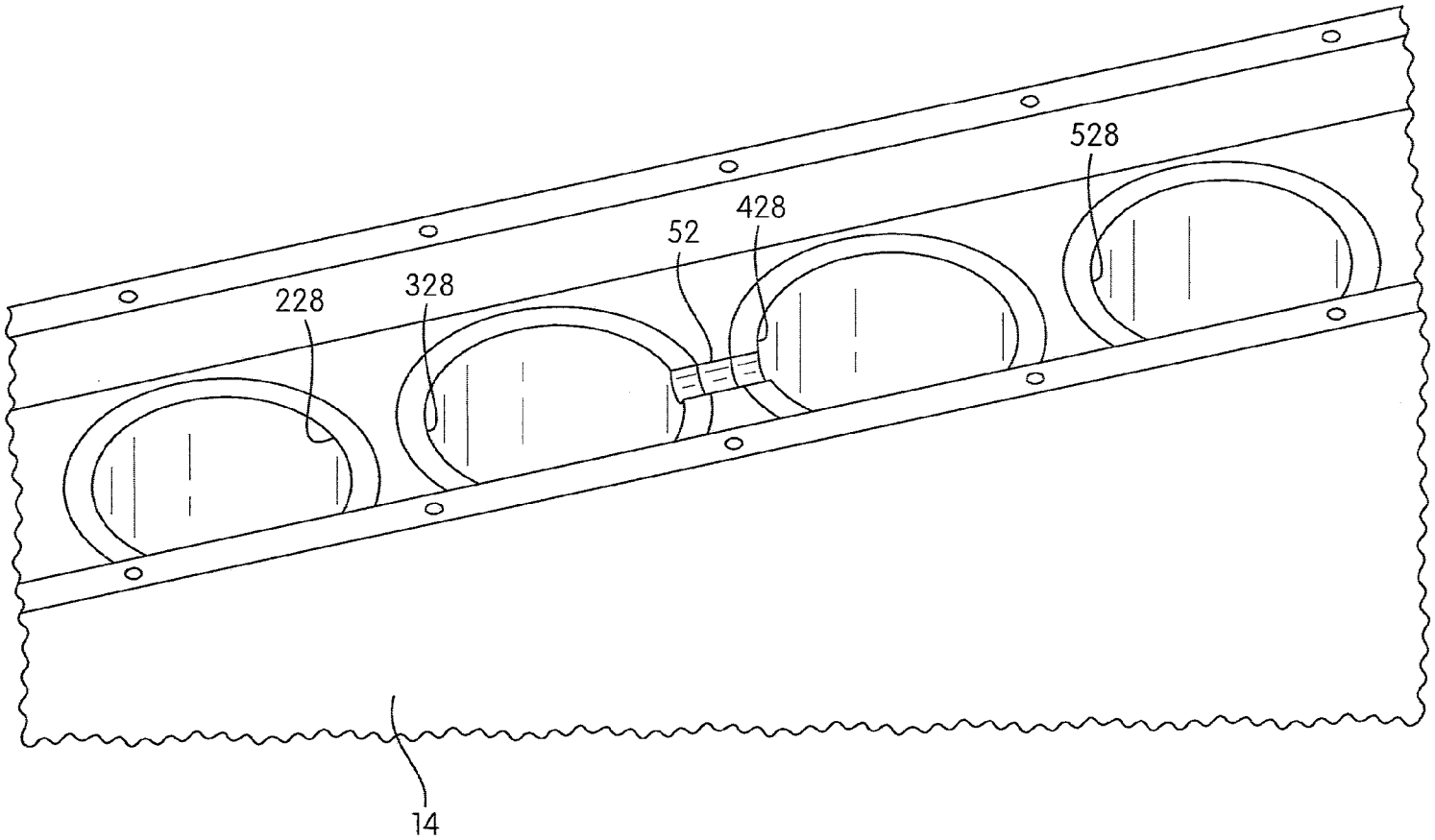
FIG. 3 is a fragmentary perspective view of a second modification in accordance with the principles of the present invention in the form of a passage in the engine block between cylinders 3 and 4.

FIG. 3 shows the modification used to accomplish the communication. As shown, the modification is simply to remove from the seal engaging surface of the frame 12 extending between cylinders 3 and 4 sufficient material, as by grinding or other means, to form a passage 52 of a minimum size suitable to enable the communication to take place. Alternatively, a portion of the seal extending from cylinder 3 to cylinder 4 can be removed.

FIG. 4 shows the modifications sufficient to enable the mode selection to take place. FIG. 4 shows one computerized fuel injecting and firing system, generally indicated at 54, for an in line six cylinder engine operating as a diesel engine. The system 54 includes a fuel injector 56 for each cylinder 1-6. Each injector 56 has a source of fuel under pressure communicating therewith, which, as shown, includes a power driven pump 58 capable of delivering fuel from a fuel tank 60 to a manifold 62 having a maximum pressure condition determined by a pressure relief valve 64 in a line between the manifold 62 and tank 60. The manifold 62 communicates the fuel pressure therein directly to the six injectors 56.

Each injector 56 has a solenoid operated valve 66 formed therein for controlling the flow of fuel under pressure communicated therewith outwardly of a nozzle end thereof. In the cases of diesel operation, the nozzle end of each injector 56 is positioned to inject fuel directly into the combustion chamber of the associated cylinder 1-6. The solenoid operated valves 66 are controlled by electrical signals coming from a computer 68 which signals determine the time and amount of fuel injected by the associated injector 66.

Referring again to FIG. 2, there is shown therein a preferred further camshaft modification embodied in the new camshaft 50 enabling a preferred, more balanced application of the forces created by the firing events in the cylinders to the crankshaft 32. Specifically, the further modification is to change the movement of inlet and outlet valves 1 and 6 and the inlet and outlet valves 2 and 5 so that the cycles in cylinders 1-6 and 2-5 are in phase rather than being 180° out of phase. Compared with camshaft 32, new camshaft 50 preferably in addition to the angular alignment of cam lobes 3 and 4 has cam lobes 6 angularly aligned with cam lobes 1 and cam lobe 2 are angularly aligned with cam lobes 5. With these further modifications the firing stroke event is initiated in two cylinders simultaneously every 240° of rotation of the crankshaft 82.

As best shown in FIG. 4, preferably, the fuel injecting and firing system 48 includes modifications which allow a selected third mode of operation wherein alternating one of injectors 1 and 6 and alternating one of injectors 2 and 5 is controlled to inject zero amount of fuel. That is, injectors 2 and 5 are being used in a known "skip-fire" style where no fuel or pressure from another source is being introduced into the associated cylinder. This third mode where cylinders 3 and 4 are also operating alternately with one injector injecting zero amount of fuel but receiving pressure from the other cylinder receiving fuel, can be identified as a maximum fuel saving mode (50% saving) whereas the previously identified fuel saving mode can be identified as an intermediate fuel saving mode (16⅔%).

In the system 54 shown in FIG. 4 the selection of which of the three modes is to operate is left up to the driver of the vehicle. FIG. 4 illustrates a box 70 having three buttons 72, 74 and 76 which when pushed provide three different signals to the computer 48.

Preferably, the signal which activates the computer 68 to emit signals commensurate with the maximum power mode is made by pressing a manual control button 72 although it could be under the control of a sensor that activates when the vehicle is going up a steep grade or the gas pedal has been floor-boarded. Preferably, the signal which activates the computer to emit signals commensurate with the maximum fuel savings mode is the separate manual control button 74 although it could be activated when the cruise control button is turned on. It is noted that cylinders 3 and 4 will both fire in the maximum power mode, while only one will fire in the maximum fuel saving mode. And, when neither maximum mode is operating, the cylinders 3 and 4 will fire one alternately (the intermediate mode).

Consequently, the preferred operation of the fuel injecting and firing system 48 is to select the intermediate mode at all times (16⅔% less fuel than max power), as by a third manual control button 76 except when added power is desired or needed (max power mode) or when the cruise control button is turned on (max fuel saving mode 50% less fuel than max power).

When the computer 48 receives a signal as a result of pushing button 72, the computer 48 is programmed to activate all of the injectors 50 at the appropriate time. When the computer 48 receives a signal as a result of pushing button 74, the computer in proper timed relation (1) alternate one of injectors 3 and 4 (2) alternate one of injectors 1 and 6 and (3) alternate one of injectors 2 and 5. When the computer 48 receives a signal as a result of pushing button 76, the computer 48 is programmed to activate in properly timed relation alternately one of injectors 3 and 4 and both injectors 1 and 6 and both injectors 2 and 5.

The modifications to be made in accordance with the principles of the present inventions are the same whether the engine is diesel ignited or spark plug ignited. In the case of a spark ignited engine the nozzle ends of the injectors 56 are directed along with a variable air supply into the cylinders through the open inlet valve during the intake stroke. While a spark plug is provided in each combustion chamber and a distributor assembly is also provided it is preferable to modify the distributor system so that when both cylinders 3 and 4 are to be fired together only one is fired and the fire in that one is used to fire the other through the communicating passage.

It should be appreciated that the foregoing embodiment(s) have been illustrated solely for the purposes of illustrating the structural and functional advantages of the present invention and is not intended to be limiting. To the contrary, the present invention includes all modifications, alterations, substitutions and equivalents within the spirit and scope of the appended claims.

What is claimed is:

1. An internal combustion engine comprising:

a frame, six piston and cylinder assemblies mounted in line in said frame, a crankshaft, a connecting rod between said crankshaft and a piston of each of said six assemblies constructed and arranged so that the pistons of two inner adjacent assemblies, two outer assemblies and two intermediate assemblies move through repetitive cycles of reciprocating movement offset with respect to one another by 120° of crankshaft rotation and in which each cycle has four strokes of piston movement alternately in opposite directions which take place during four successive 180° rotational movements of said crankshaft, inlet and outlet valves for each assembly movable between opening and closing relation with respect to a cylinder of an associated assembly, a camshaft for controlling the movements of said inlet and outlet valves in successive cycles corresponding with the successive cycles of said pistons so that (1) during each cycle of said pistons air is taken into a cylinder of each assembly during an intake stroke and compressed within a combustion chamber therein to a compression pressure during an immediately following compression stroke, and (2) the compression strokes of the pistons of the two inner assemblies occur simultaneously, a passage communicating the combustion chambers of the two inner piston and cylinder assemblies, and a controlled fuel injecting and firing system including an injector for each assembly for injecting fuel into a cylinder during a stroke of an associated piston therein so that a mixture of fuel and compressed air in the combustion chamber thereof can be ignited to affect a power stroke of the assembly immediately following the compression stroke thereof, said controlled fuel injecting and firing system being operable to selectively control the injectors associated with said inner piston and cylinder assemblies (1) in a normal mode wherein fuel is injected into both cylinders of said inner assemblies during a stroke of both pistons of the inner assemblies so that a mixture of fuel and compressed air in the combustion chambers thereof can be ignited to affect simultaneous internally fired power drive strokes of both pistons or (2) in a fuel saving mode wherein fuel is injected into one of the cylinders of said inner assemblies during a stroke of the associated piston so that a mixture of fuel and compressed air in the combustion chamber of the one inner assembly can be ignited with the resultant increase in pressure therein being shared by said passage with the compressed air in the combustion chamber of the other inner assembly to affect the simultaneous internally fired and shared power drive strokes of the pistons of both said inner assemblies.

2. An internal combustion engine as defined in claim 1 wherein said camshaft is constructed and arranged so that the firing strokes of the two outer and two intermediate assemblies are simultaneous, said fuel injecting and firing system is constructed and arranged to control the injectors being operable to selectively control the injectors of the two outer and two intermediate assemblies in a third mode wherein one injector associated with each of said two outer and two intermediate assemblies is controlled to inject zero amount of fuel.

3. An internal combustion engine as defined in claim 2 wherein said fuel injecting and firing system is operable to control an injector to inject fuel into a cylinder during an associated piston stroke when the compressed air in the associated combustion chamber has reached an auto ignition pressure so that the igniting of the mixture occurs as a result of the injection.

4. An internal combustion engine as defined in claim 2 wherein said fuel injecting and firing system is operable to control an injector to inject fuel into a cylinder during an associated piston intake stroke and the mixture of fuel and compressed air in the associated combustion chamber is ignited by energizing a spark plug in communicating relation to the mixture.

5. An internal combustion engine as defined in claim 1 wherein said fuel injecting and firing system is operable to control an injector to inject fuel into a cylinder during an associated piston stroke when the compressed air in the associated combustion chamber has reached an auto ignition pressure so that the igniting of the mixture occurs as a result of the injection.

6. An internal combustion engine as defined in claim 1 wherein said fuel injecting and firing system is operable to control an injector to inject fuel into a cylinder during an associated piston stroke when the compressed air in the associated combustion chamber has reached an auto ignition pressure so that the igniting of the mixture occurs as a result of the injection.

7. A method of increasing the efficiency of a six cylinder in line engine having six piston and cylinder assemblies mounted in line formation within a frame, the assemblies having pistons connected to a crankshaft so that the pistons of two inner adjacent assemblies, two outer assemblies and two intermediate assemblies move through repetitive cycles of reciprocating movement offset with respect to one another by 120° of crankshaft rotation in which each cycle has four strokes of movement alternately in opposite directions which take place during successive 180° rotational movements of said crankshaft, a camshaft for controlling inlet and outlet valves to allow air to be taken into a cylinder during an intake stroke of each assembly and to be compressed into a combustion chamber within a cylinder of each assembly during an immediately following compression stroke of each assembly and a fuel injecting and firing system including an injector for each assembly operable to supply fuel during a stroke of the assembly so that when a charge of air under pressure mixed with fuel is ignited within a combustion chamber the resultant increase in pressure in the associated cylinder affects a power stroke of an associated piston immediately following the compression stroke of the assembly, said method comprising:

replacing the camshaft of the engine which controls the valves of the inner assemblies with a replacement camshaft constructed and arranged so that the cycles of piston movement of said two inner assemblies are in phase, providing a communicating passage between the combustion chambers of the two inner assemblies, and modifying the fuel injecting and firing system so that the injectors for the two inner assemblies are selectively operable to operate (1) in a normal mode wherein the injectors associated with both inner assemblies operate to supply fuel during a stroke of both assemblies so that when a charge of air under pressure mixed with fuel is ignited within both combustion chambers the resultant increase in pressure in both cylinders affects simultaneous internally fired power drive strokes of the pistons in both cylinders or (2) in a fuel saving mode wherein the injector associated with one of said inner assemblies operates to supply fuel during a stroke of the associated piston so that when a charge of air under pressure mixed with fuel within the combustion chamber of the one of said inner assemblies is ignited, the resultant increase in pressure in the combustion chamber of the one of the inner assemblies is communicated through the passage with the air under pressure in the combustion chamber of the other of said inner assemblies to affect the power stroke of both assemblies.

8. A method as defined in claim 7 wherein the compression stroke of each assembly creates an auto-ignition compression pressure and wherein the mixture is ignited by injecting fuel into the air under auto-ignition pressure within the associated combustion chamber.

9. A method as defined in claim 7 wherein the mixture of air and fuel in the associate combustion chamber by injecting fuel with the intake of air during each intake stroke and the mixture is ignited by the energization of a spark plug in communication with the mixture.

10. A method as defined in claim 7 wherein the new camshaft controls the valves of the two outer and two intermediate assemblies so that cycles of the two outer and two intermediate assemblies are in phase, and the injectors of the fuel injecting and firing system is constructed and arranged to control the injectors associated with the two outer and two intermediate assemblies in a third mode wherein one of the injectors of the two outer and two intermediate assemblies inject a zero amount of fuel.

11. A method as defined in claim 7 wherein said passage is provided by grinding inwardly of a seal engaging surface of the frame between the cylinders of the two inner assemblies.

* * * * *